US012480367B2

(12) United States Patent
Nordenstam

(10) Patent No.: US 12,480,367 B2
(45) Date of Patent: Nov. 25, 2025

(54) DOWNHOLE TOOL, METHOD, AND SYSTEM

(71) Applicant: Baker Hughes Oilfield Operations LLC, Houston, TX (US)

(72) Inventor: Erik Nordenstam, The Woodlands, TX (US)

( * ) Notice: Subject to any disclaimer, the term of this patent is extended or adjusted under 35 U.S.C. 154(b) by 0 days.

(21) Appl. No.: 18/506,372

(22) Filed: Nov. 10, 2023

(65) Prior Publication Data

US 2025/0154831 A1 May 15, 2025

(51) Int. Cl.

| | |
|---|---|
| ***E21B 17/02*** | (2006.01) |
| ***E21B 4/02*** | (2006.01) |
| ***E21B 17/03*** | (2006.01) |
| ***E21B 17/06*** | (2006.01) |

(52) U.S. Cl.

CPC ..... *E21B 17/021* (2013.01); *E21B 17/02* (2013.01); *E21B 17/03* (2013.01); *E21B 17/06* (2013.01); *E21B 4/02* (2013.01)

(58) Field of Classification Search

CPC ..... E21B 4/02; E21B 17/02; E21B 17/021; E21B 17/03; E21B 17/04; E21B 17/06

See application file for complete search history.

(56) References Cited

U.S. PATENT DOCUMENTS

| | | | | |
|---|---|---|---|---|
| 6,497,295 | B1 * | 12/2002 | Carmichael | E21B 47/095 175/48 |
| 7,152,698 | B2 | 12/2006 | Dewey | |
| 7,225,889 | B2 | 6/2007 | Dewey | |
| 2003/0183388 | A1 * | 10/2003 | Toulouse | E21B 7/061 166/117.6 |
| 2004/0089480 | A1 | 5/2004 | Dewey | |
| 2004/0202521 | A1 | 10/2004 | Bostik | |
| 2008/0066901 | A1 | 3/2008 | Gereluk | |
| 2013/0032326 | A1 * | 2/2013 | Lea-Wilson | E21B 17/06 403/2 |
| 2013/0140029 | A1 * | 6/2013 | Sullivan | E21B 17/06 166/99 |
| 2020/0109608 | A1 | 4/2020 | Elfar | |
| 2024/0052719 | A1 * | 2/2024 | Kent | E21B 17/06 |

OTHER PUBLICATIONS

Notification of Transmittal of the International Search Report and the Written Opinion of the International Searching Authority, or the Declaration; PCT/US2024/054677; Mail date: Feb. 18, 2025; 7 pages.

* cited by examiner

*Primary Examiner* — Brad Harcourt

(74) *Attorney, Agent, or Firm* — Baker Hughes Company

(57) ABSTRACT

A downhole tool, including first and second sections, the second section being rotatable relative to the first section, a lock sleeve attached to the first and second sections, the lock sleeve being unlockable by application of a threshold torque acting between the first section and the second section. A positive displacement motor assembly, including a housing, a power section, and a stator, a drive sub connected to the rotor, and a lock sleeve nonrotatably attached to the housing and to the drive sub, the lock sleeve being releasable at a selected threshold torque between the housing and the drive sub. A method for forming a casing exit, including running a tool to a target location in a borehole, causing the first section and the second section to experience different rotational strain, releasing the lock sleeve at a torque threshold between the first and second sections.

16 Claims, 9 Drawing Sheets

DOWNHOLE TOOL, METHOD, AND SYSTEM

BACKGROUND

In the resource recovery and fluid sequestration industries various activities employ rotary tools. In some cases, rotation of the tools prematurely can be detrimental. Apparatus and method to control this issue would be a benefit to the industry.

SUMMARY

An embodiment of a downhole tool, including a first section, a second section, the second section being rotatable relative to the first section, a lock sleeve attached to the first section and the second section, the lock sleeve being selectively unlockable by application of a threshold torque acting between the first section and the second section.

An embodiment of a positive displacement motor assembly, including a housing, a power section in the housing having a rotor and a stator, a drive sub connected to the rotor, and a lock sleeve nonrotatably attached to the housing and to the drive sub, the lock sleeve being releasable at a selected threshold torque between the housing and the drive sub.

An embodiment of a method for forming a casing exit, including running a tool, to a target location in a borehole, causing the first section and the second section to experience different rotational strain, releasing the lock sleeve at a selected torque threshold between the first and second sections.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
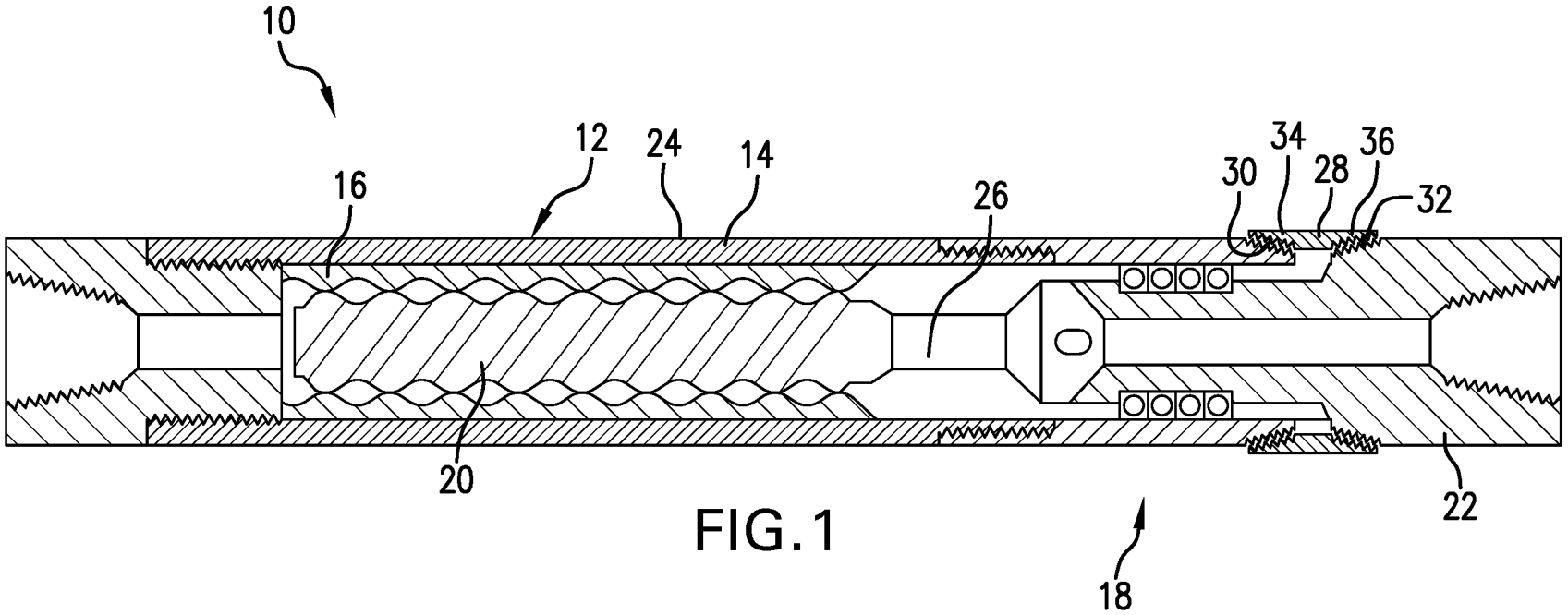
FIG. 1 is a schematic sectional view of a downhole tool disclosed herein.

Referring to FIG. 1, a first example of a downhole tool 10 disclosed herein is illustrated. It is noted that while the specifically illustrated tool is a positive displacement mud motor based rotary tool, the invention is not so limited. Rather, the disclosure hereof is applicable to any downhole tool having relatively rotating sections and that may benefit from the prevention of premature relative rotation.

Tool 10, as specifically illustrated in FIG. 1, includes a first section 12 that is embodied as a housing 14 and stator 16 relative to which a second section 18, embodied as a rotor 20 and drive sub 22, may rotate. The tool 10 may also be understood to comprise a power section 24 including the housing 14, stator 16 and rotor 20, and a transmission 26, which may be a shaft connecting the rotor 20 to the drive sub 22. In each of these understandings of the structure of tool 10, there is a lock sleeve 28 that connects the first section 12 to the second section 18 or stated alternatively in an embodiment from the drive sub 22 to the housing 14. Lock sleeve 28 prevents relative rotation between the parts as recited until a preselected torque is borne by the lock sleeve 28. That is, in an embodiment, the power section 24, based upon flowing mud through the power section 24 is generating torque that is applied through the transmission 26 to the drive sub 22, which is prevented from rotating by the lock sleeve 28 due to an interengagement feature or features that retain the sleeve 28 to both the power section 24 and the drive sub 22. This torque experienced through the lock sleeve 28 will be held thereby until the selected threshold torque is reached whereafter the lock sleeve 28 will release, allowing the drive sub 22 to rotate freely based upon the power section 24 driving the sub 22.

The lock sleeve 28 may be threaded to the housing 14 and/or to the drive sub 22 by threads 30 and 32 at longitudinal ends 34 and 36, respectively, of the lock sleeve 28, in one embodiment of the interengagement feature. Alternatively, or in combination if one of the ends 34 or 36 uses threads or uses one of the alternates disclosed below, the ends 34 and/or 36 may be configured with splines, keys, castellations, sweat fittings, shrink fittings, set screws, lock rings, etc. Ultimately, the function of rotationally securing the lock sleeve 28 to each of the first section 12 and second section 18 so that torque is reliably transmitted to the lock sleeve 28 is important to the function of the tool 10 both for preventing premature relative rotation and ensuring the preselected threshold is reachable without the uncertainty created by the lock sleeve 28 slipping at its connections to the first and second sections. Somewhere between the first and second ends 34 and 36 is a release configuration 40. It is this configuration that sets the threshold torque at which the lock sleeve 28 will release.

Figure 2:
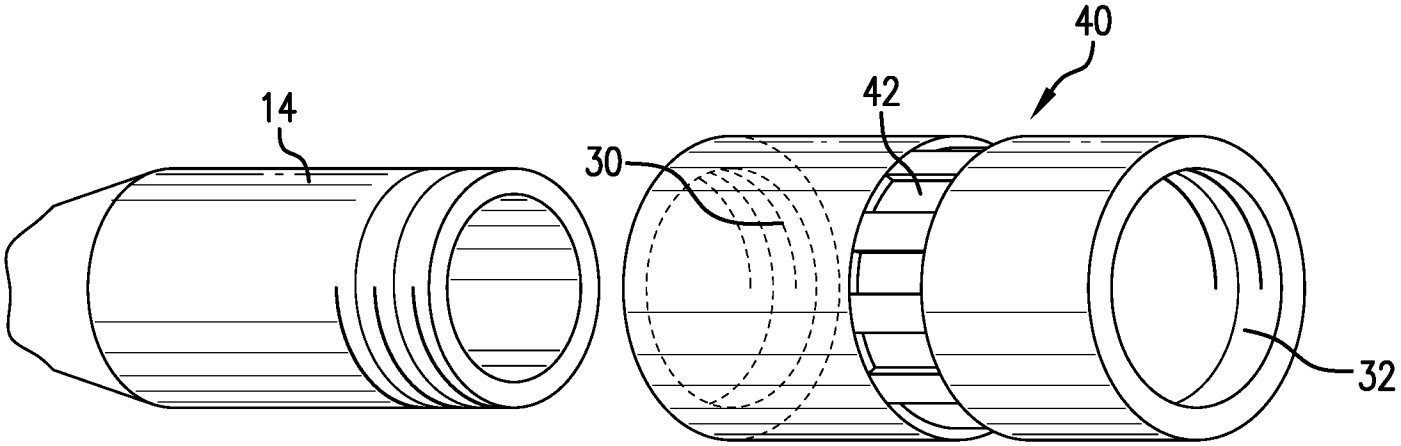
FIG. 2 is an enlarged view of an embodiment of the lock sleeve as disclosed herein.

Referring to FIG. 2, an embodiment of the lock sleeve 28 is illustrated in an enlarged view. FIG. 2 illustrates a release configuration 40 that includes a perforation 42 of the material of the lock sleeve 28. In embodiments, there may be any number of perforations including a line of perforations that extend all the way around the lock sleeve 28 as illustrated. Perforations 42 may be of any geometric shape such as the rectangular shape illustrated, circular, etcetera. Perforations are stress risers in the material of the lock sleeve 28 and are tailorable to release at a selected threshold torque placed thereon. Similarly, perforations could be replaced by a thinner portion of the lock sleeve 28 or other weakening of the material in the location of the perforations.

Figure 3:
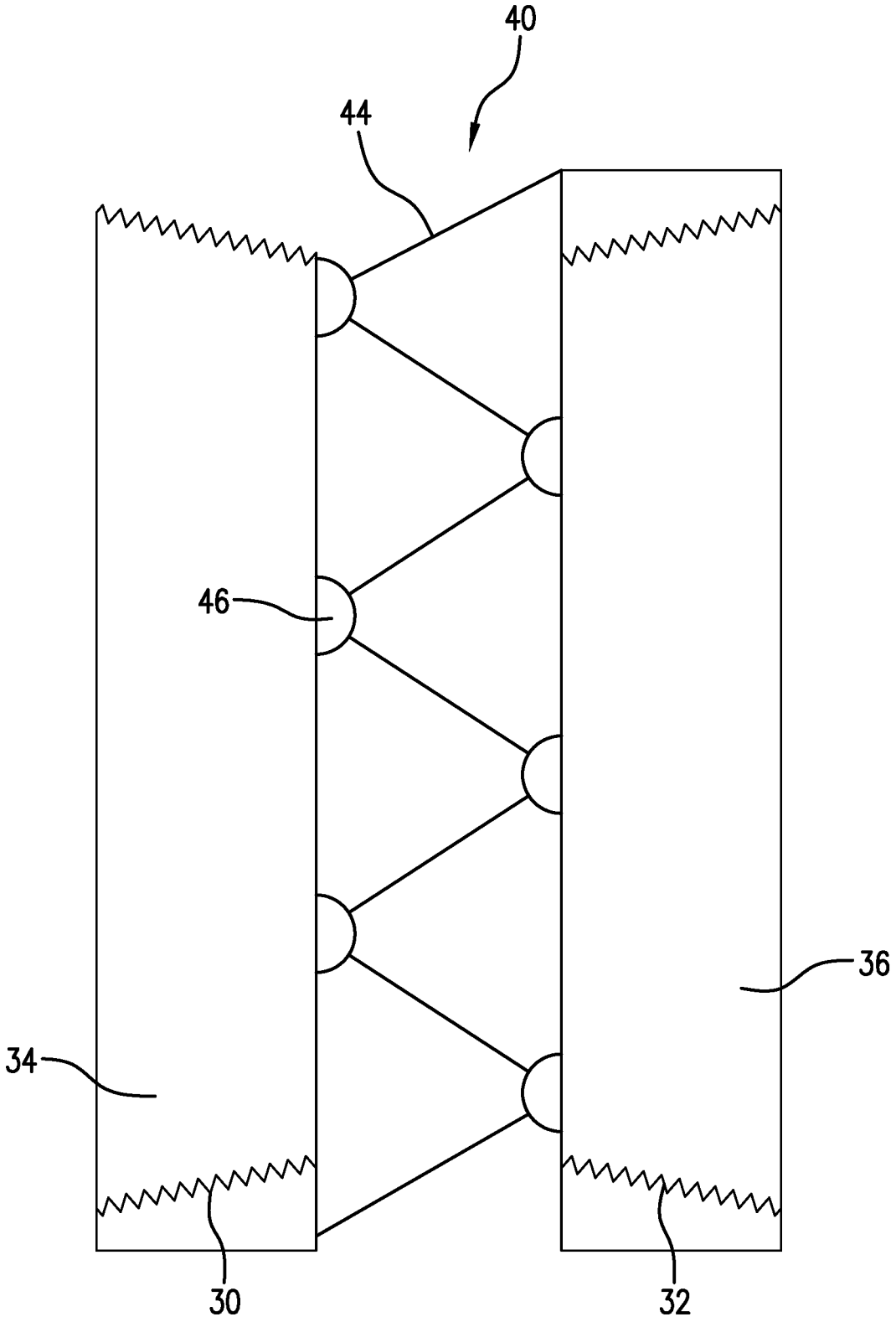
FIG. 3 is an enlarged view of another embodiment of the lock sleeve as disclosed herein.

Referring to FIG. 3, an alternative lock sleeve 28 is illustrated. This embodiment employs a release configuration 40 that comprises a ductile shear tether 44 secured to ends 34 and 36 of the lock sleeve 28 at anchor points 46. The tether 44 may comprise a wire, rope, chain, twine, cable, filament, etc. again allowing selection of a threshold value for release in the lock sleeve 28.

Figure 4:
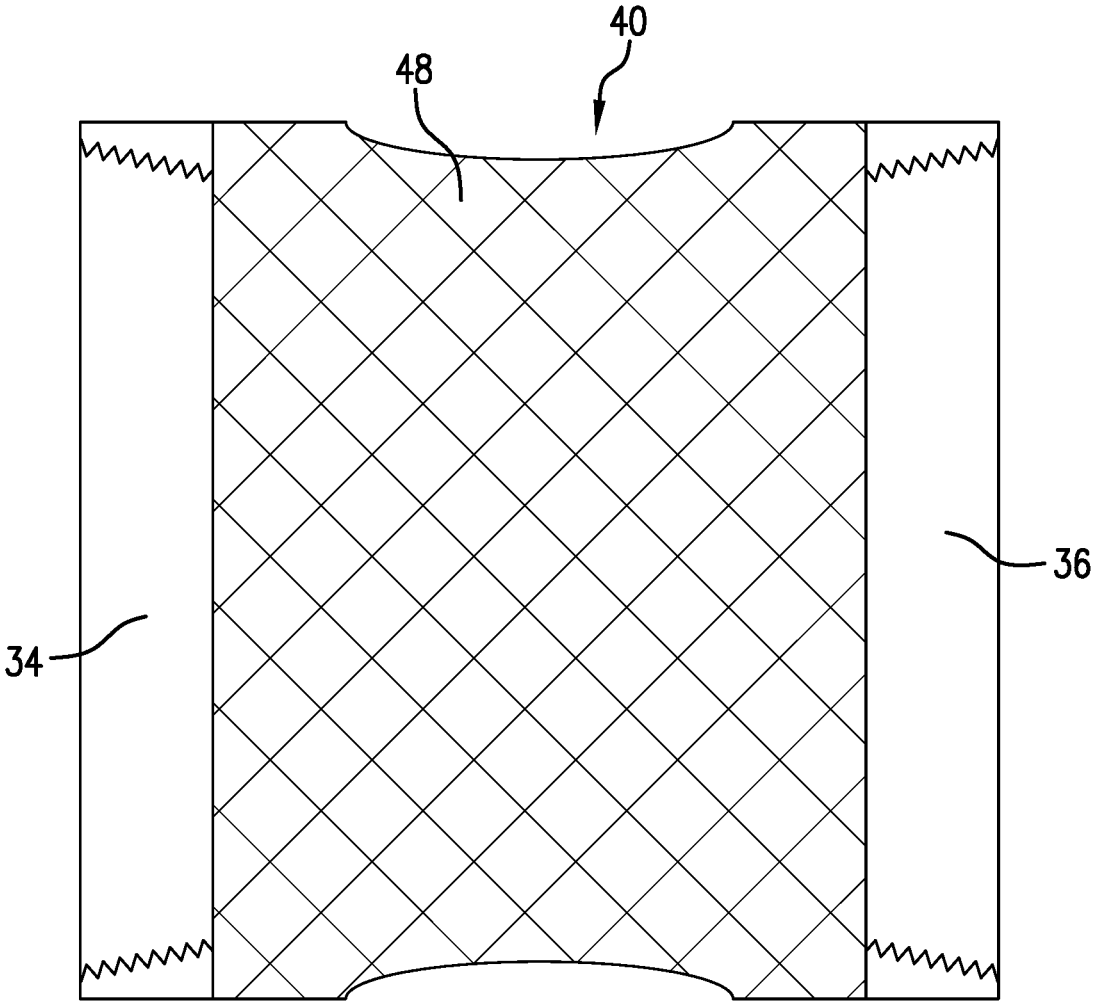
FIG. 4 is an enlarged view of another embodiment of the lock sleeve as disclosed herein.

In yet another embodiment, referring to FIG. 4, lock sleeve 28 is configured as a shearable sheet material 48 such as fabric (woven or nonwoven), or membrane (plastic rubber, etc.), etc. The material 48 is bonded to or printed integrally with ends 34 and 36 of sleeve 28 and provides the ability to preselect the threshold for release of the lock sleeve 28.

It is to be understood that while the described embodiments make use of a concept of the release configuration between the ends 34 and 36, it is also contemplated that the release configuration 40 be integrated into one of the ends 34 or 36. Ultimately, the release configuration 40 is to ensure the lock sleeve 28 ceases to prevent relative rotation between the first and second sections 12, 18 at a threshold torque that was preselected and manufactured into the lock sleeve 28.

In another embodiment of release configuration 40, set screws 50 and lock keys 52 replace the function of threads 30 and 32. Configuration 40 is secured in place longitudinally by the set screws 50 and rotationally by the lock keys 52. Release is still provided by perforations 42 in this embodiment. In this embodiment the housing 14 is also modified to provide a set screw groove 54 and lock key keyways 56 to engage the set screws 50 and lock keys 52, respectively.

Figure 5:
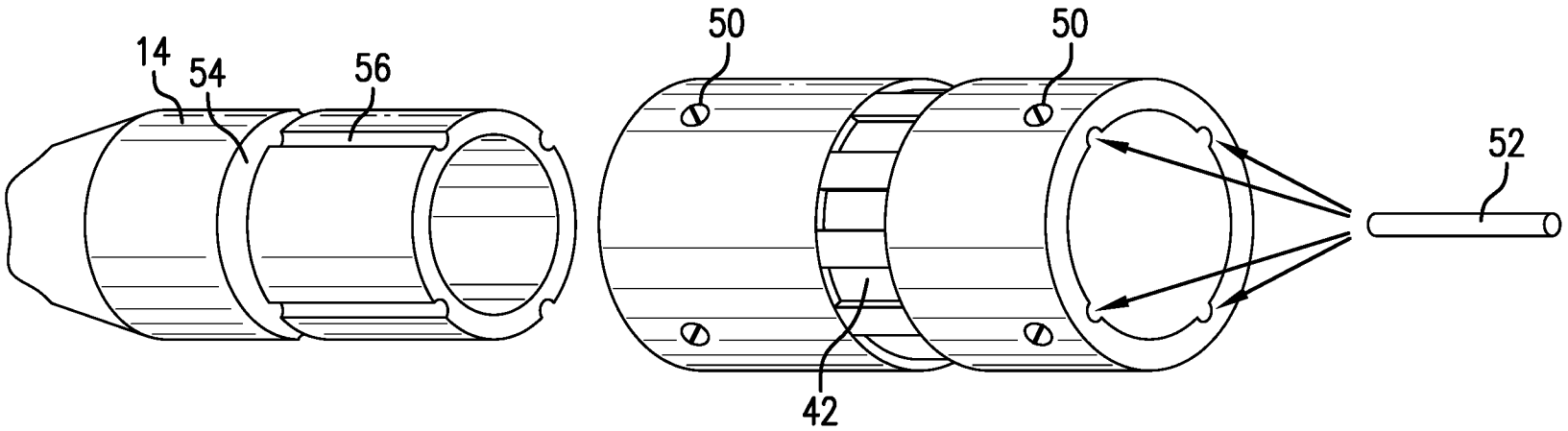
FIG. 5 is an enlarged view of another embodiment of the lock sleeve as disclosed herein.
Figure 6:
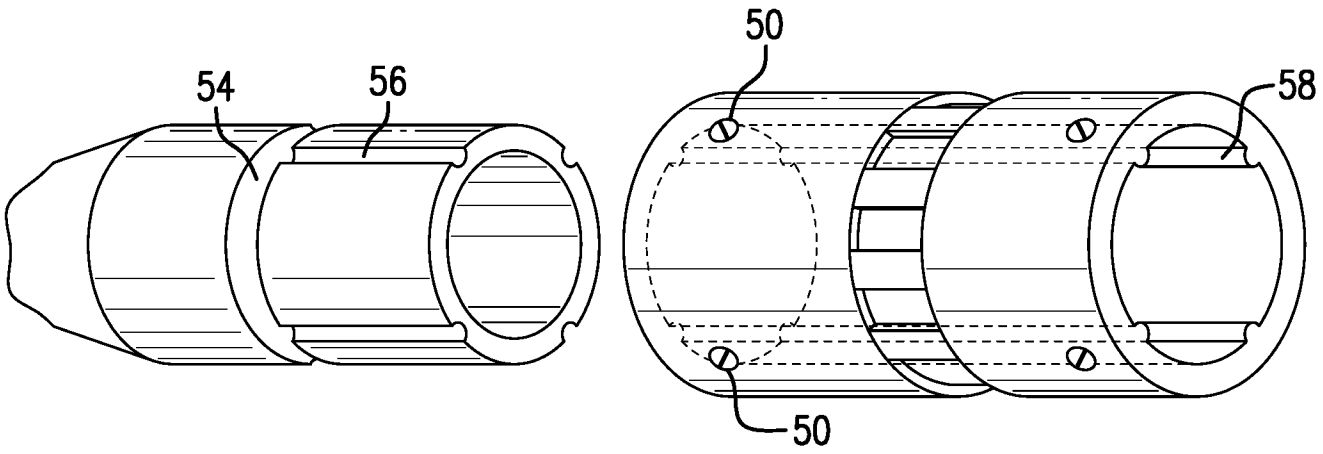
FIG. 6 is an enlarged view of another embodiment of the lock sleeve as disclosed herein.

Referring to FIG. 6, another embodiment is illustrated. The embodiment differs from FIG. 5 only in that the lock keys 52 are eliminated in favor of splines 58. In other respects the embodiment is the same as FIG. 5.

Figure 7:
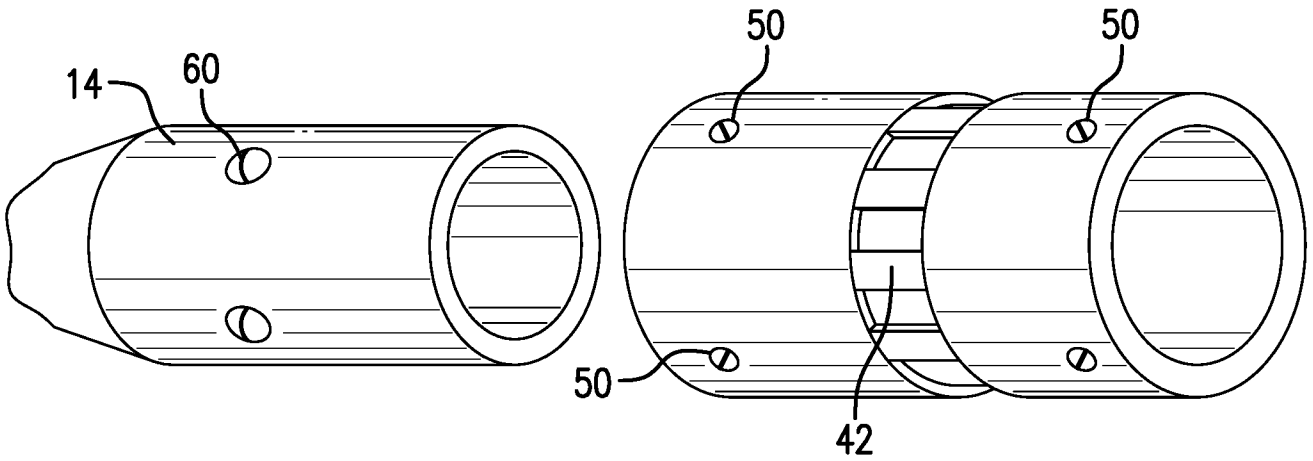
FIG. 7 is an enlarged view of another embodiment of the lock sleeve as disclosed herein.

Referring to FIG. 7, another embodiment is illustrated that combines the axial retention of the set screws 50 with a rotational retention in that the set screws 50 are received in discrete recesses 60 rather than the grooves 54 of the previous embodiments. In other respects, the embodiment is similar to that of FIG. 2.

Figure 8:
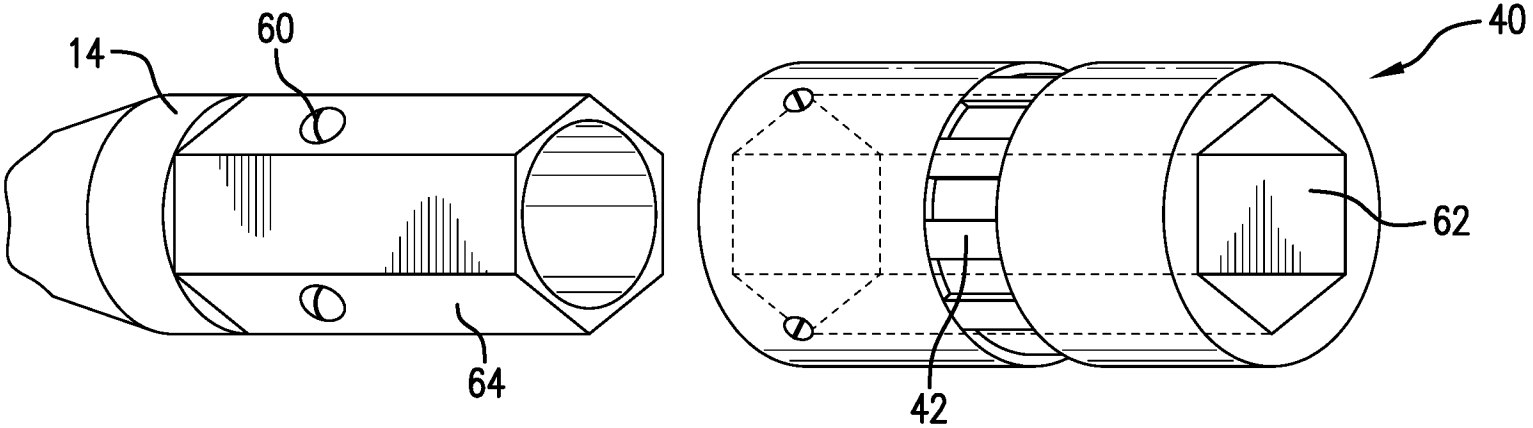
FIG. 8 is an enlarged view of another embodiment of the lock sleeve as disclosed herein.

Referring to FIG. 8, another embodiment of the release configuration 40 is illustrated that continues to use the perforations 42 (recognizing that the alternatives to perforations noted herein are contemplated). Rotational retention in this embodiment is through selection of a geometric cross section 62 that is noncircular. The geometric cross section is mimicked on an outer surface 64 of the housing 14 with clearance dimensions so that the configuration 40 may slide over the surface 64 and then be secured in that position by the set screws 50 into the discrete recesses 60. As illustrated, the geometry is hexagonal but all geometric noncircular shapes are contemplated.

Figure 9:
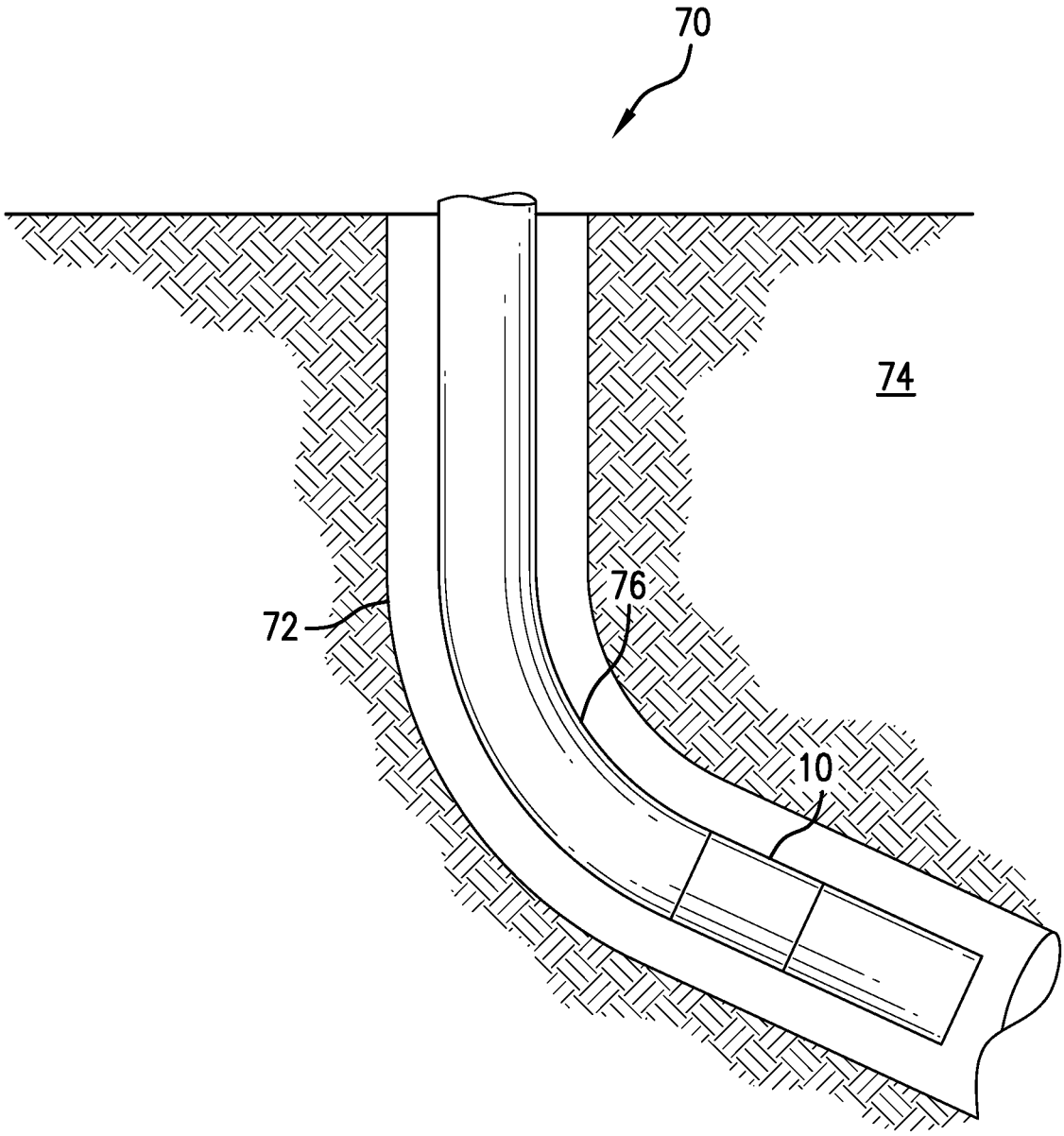
FIG. 9 is a view of a borehole system including the tool as disclosed herein.

Referring to FIG. 9, a borehole system 70 is illustrated. The system 70 comprises a borehole 72 in a subsurface formation 74. A string 76 is disposed within the borehole 72. A downhole tool 10 as disclosed herein is disposed within or as a part of the string 76.

Set forth below are some embodiments of the foregoing disclosure:

Embodiment 1: A downhole tool, including a first section, a second section, the second section being rotatable relative to the first section, a lock sleeve attached to the first section and the second section, the lock sleeve being selectively unlockable by application of a threshold torque acting between the first section and the second section.

Embodiment 2: The tool as in any prior embodiment, wherein the first section comprises a housing.

Embodiment 3: The tool as in any prior embodiment, wherein second section comprises a motor rotatable within the housing.

Embodiment 4: The tool as in any prior embodiment, wherein the motor is a positive displacement mud motor.

Embodiment 5: The tool as in any prior embodiment, wherein the lock sleeve including a first securement feature configured to secure a first longitudinal end of the lock sleeve to the first section, a second securement feature configured to secure a second longitudinal end of the lock sleeve to the second section, and a selected torque release feature.

Embodiment 6: The tool as in any prior embodiment, wherein one or both of the first and second securement features includes a thread.

Embodiment 7: The tool as in any prior embodiment, wherein the thread is a left-hand thread.

Embodiment 8: The tool as in any prior embodiment, wherein one or both of the first and second securement features includes an interengagement feature.

Embodiment 9: The tool as in any prior embodiment, wherein the interengagement is a spline.

Embodiment 10: The tool as in any prior embodiment, wherein the interengagement is a key.

Embodiment 11: The tool as in any prior embodiment, wherein the interengagement is a noncircular geometry.

Embodiment 12: The tool as in any prior embodiment, wherein one or both of the first and second securement features includes an interference fit.

Embodiment 13: The tool as in any prior embodiment, wherein one or both of the first and second securement features includes a set screw.

Embodiment 14: The tool as in any prior embodiment, wherein the release feature is a perforation.

Embodiment 15: The tool as in any prior embodiment, wherein the release feature is a line of perforations.

Embodiment 16: The tool as in any prior embodiment, wherein the release feature is a weakened portion of the lock sleeve.

Embodiment 17: The tool as in any prior embodiment, wherein the release feature is a shear tether.

Embodiment 18: The tool as in any prior embodiment, wherein the release feature is a sheet material.

Embodiment 19: A positive displacement motor assembly, including a housing, a power section in the housing having a rotor and a stator, a drive sub connected to the rotor, and a lock sleeve nonrotatably attached to the housing and to the drive sub, the lock sleeve being releasable at a selected threshold torque between the housing and the drive sub.

Embodiment 20: A method for forming a casing exit, including running a tool as in any prior embodiment, to a target location in a borehole, causing the first section and the second section to experience different rotational strain, releasing the lock sleeve at a selected torque threshold between the first and second sections.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool, comprising:

a first section;

a second section, the second section being rotatable relative to the first section;

a lock sleeve attached to the first section and the second section, the lock sleeve being selectively unlockable by application of a threshold torque acting between the first section and the second section, wherein the lock sleeve comprises:

a first securement feature configured to secure a first longitudinal end of the lock sleeve to the first section;

a second securement feature configured to secure a second longitudinal end of the lock sleeve to the second section; and a selected torque release feature and wherein one or both of the first and second securement features includes an interengagement feature, the interengagement being a noncircular geometry.

2. The tool as claimed in claim 1, wherein the first section comprises a housing.

3. The tool as claimed in claim 2, wherein second section comprises a motor rotatable within the housing.

4. The tool as claimed in claim 3, wherein the motor is a positive displacement mud motor.

5. The tool as claimed in claim 1, wherein one or both of the first and second securement features includes a thread.

6. The tool as claimed in claim 5, wherein the thread is a left-hand thread.

7. The tool as claimed in claim 1, wherein one or both of the first and second securement features includes an interference fit.

8. The tool as claimed in claim 1, wherein the release feature is a perforation.

9. The tool as claimed in claim 1, wherein the release feature is a line of perforations.

10. The tool as claimed in claim 1, wherein the release feature is a weakened portion of the lock sleeve.

11. The tool as claimed in claim 1, wherein the release feature is a sheet material.

12. A method for forming a casing exit, comprising:

running a tool as claimed in claim 1 to a target location in a borehole;

causing the first section and the second section to experience different rotational strain;

releasing the lock sleeve at a selected torque threshold between the first and second sections.

13. A downhole tool, comprising a first section;

a second section, the second section being rotatable relative to the first section;

a lock sleeve attached to the first section and the second section, the lock sleeve being selectively unlockable by application of a threshold torque acting between the first section and the second section, the lock sleeve the look sleeve comprising:

a first securement feature configured to secure a first longitudinal end of the lock sleeve to the first section;

a second securement feature configured to secure a second longitudinal end of the lock sleeve to the second section; and a selected torque release feature, wherein one or both of the first and second securement features includes an interengagement feature, and wherein the interengagement is a spline.

14. A downhole tool, comprising:

a first section;

a second section, the second section being rotatable relative to the first section;

a lock sleeve attached to the first section and the second section, the lock sleeve being selectively unlockable by application of a threshold torque acting between the first section and the second section, the lock sleeve the lock sleeve comprising:

a first securement feature configured to secure a first longitudinal end of the lock sleeve to the first section;

a second securement feature configured to secure a second longitudinal end of the lock sleeve to the second section; and a selected torque release feature, wherein one or both of the first and second securement features includes an interengagement feature, and wherein the interengagement is a key.

15. A downhole tool, comprising:

a first section;

a second section, the second section being rotatable relative to the first section;

a lock sleeve attached to the first section and the second section, the lock sleeve being selectively unlockable by application of a threshold torque acting between the first section and the second section, the lock sleeve the lock sleeve comprising:

a first securement feature configured to secure a first longitudinal end of the lock sleeve to the first section;

second securement feature configured to secure a second longitudinal end of the lock sleeve to the second section; and a selected torque release feature, and wherein one or both of the first and second securement features includes a set screw.

16. A downhole tool, comprising:

a first section;

a second section, the second being rotatable relative to the first section;

a lock sleeve Red to the first section and the second section, the lock sleeve being selectively unlockable by application of a threshold torque acting between the first section and the second section, the lock sleeve the lock sleeve comprising:

a first securement feature configured to secure a first longitudinal end of the lock sleeve to the first section;

a second securement feature configured to secure a second longitudinal end of the look sleeve to the second section; and a selected torque release feature, and wherein the release feature is a shear tether.

* * * * *